US006010416A

United States Patent [19]

Frederick

[11] Patent Number: 6,010,416

[45] Date of Patent: Jan. 4, 2000

[54] PORTABLE ATHLETIC FIELD BOUNDARY

[76] Inventor: John Garrett Frederick, P. O. Box 112566, Carrollton, Tex. 75011-2566

[21] Appl. No.: 09/039,821

[22] Filed: Mar. 16, 1998

[51] Int. Cl.[7] ..... A63B 7/02

[52] U.S. Cl. ..... 473/490

[58] Field of Search ..... 473/490

[56] References Cited

U.S. PATENT DOCUMENTS 3,985,359 10/1976 Moore .
4,218,059 8/1980 Eiden .
4,429,872 2/1984 Capachi .
4,880,243 11/1989 Raub .
5,280,921 1/1994 Milburn .
5,312,109 5/1994 Cagle .
5,427,383 6/1995 Viens .

*Primary Examiner*—William H. Grieb

[57] ABSTRACT

A portable field boundary for field sports such as soccer, football, flag football, rugby, field hockey, ultimate, lacrosse or others is formed of a flexible cord or twine with pennants or flags or other marking devices being permanently attached to the cord to denote appropriate desired points such as corners, goals, goal lines, mid-field, yardage increments or other desired elements. The boundary is designed to lay restingly on the ground with stakes or other anchoring devices used to affix the boundary to the desired surface defining the corners and perimeter of the playing field. The design is lightweight and durable to allow for multiple subsequent temporary applications, retrievals and storage of the apparatus, the duration of a single use typically being a single practice or competition.

6 Claims, 2 Drawing Sheets

PORTABLE ATHLETIC FIELD BOUNDARY

BACKGROUND OF INVENTION

1. Field of the Invention

The present invention relates in general to athletic field boundaries, and in particular to a method of defining and quickly establishing temporary boundaries and proper demarcations for the playing field of the sport being practiced or played.

2. Prior Art

Traditional field sports such as football, flag football, soccer, rugby, field hockey, ultimate frisbee and lacrosse that are played on rectangular playing fields continue to grow in popularity year after year. The availability of suitable areas for practice and competition among amateur athletes presents a problem. Coaches and organizers for participants, from youth soccer teams to adult rugby, generally locate grassy areas in parks or at school yards, then proceed define the playing field with makeshift objects such as clothing, gym bags or cones. Conventional means of more permanently marking playing fields include chalk, paint or trenching to remove grass along the sidelines and end lines to define the playing field.

Various apparatus and methods have been used for laying out playing areas, including EIDEN, U.S. Pat. No. 4,218,059, which describes field markers imbedded into the ground as a more permanent demarcation; CAPACHI, U.S. Pat. No. 4,429,872 which also describes a permanent boundary imbedded into the ground; MILBURN, U.S. Pat. No. 5,280,921 which describes a device and methodology for preparing an athletic field for application of paint or chalk. In CAGLE, U.S. Pat. No. 5,312,109 a portable soccer court is described which includes enclosing walls and a plurality of rigid transparent panels defining said court.

Also, various apparatus and methods have been used for laying out playing courts for tennis, volleyball and badminton, but these methods lack the appropriate demarcation elements for field sports where goals of particular width or goal lines for determination of scoring are required including MOORE, U.S. Pat. No. 3,985,359; RAUB, U.S. Pat. No. 4,880,243; VIENS, U.S. Pat. No. 5,427,383.

Heretofore, there has been no simple, economical, portable means of quickly establishing a boundary of proper size with the appropriate demarcations for practice or competition of field sports that can be easily dispatched, retrieved and stored for subsequent future uses.

OBJECT AND SUMMARY

Accordingly, it is the principal object of this invention to provide a simple, economical, portable means of establishing a boundary of proper size with the appropriate demarcations for such things as corners, mid-field, goals, goal lines, yardage markers and other demarcations for playing fields of field sports such as football, flag football, soccer, rugby, field hockey, ultimate frisbee and lacrosse with said demarcations being appropriate for the given sport.

The method and apparatus of the present invention includes a simple, continuous, flexible, singular cord, tape, rope, string, twine, braided cloth or other material of appropriate length that lies restingly on the ground and outlines the entire perimeter of a sports field for the practice or competition of field sports such as football, flag football, soccer, rugby, field hockey, lacrosse, ultimate frisbee and other field sports that are played on rectangular playing fields with said boundary having a first and a second end separated by a distance equal to the sum of the length of the four sides with colored pennants, flags, tape, streamers, dye, ink or other markers sewn, glued, printed or otherwise attached denoting appropriate field demarcations such as goals, goal lines, corners, mid-field, yardage markers and other useful and appropriate demarcations. Various alternating colors could be used to denote different demarcations, with corners being one color and goals and goal lines being a different color while midfield and yardage markers being yet another color. Said first end and said second end of the boundary being attached to a common point forming and endless loop.

Establishing said boundaries would be accomplished by staking or otherwise affixing one end of the flexible cord into the ground, then proceeding to lay out additional cord until the first corner demarcation is reached. A second stake would be inserted into the ground at this corner demarcation and the cord would be pulled taunt to eliminate any slack and drawn against the outside of said stake or wrapped around said stake. The applicant would then proceed at a 90 degree angle laying out additional cord until the next corner demarcation is reached. A third stake would be inserted into the ground at this corner demarcation and the cord would be pulled taunt to eliminate any slack and drawn against the outside of said stake or wrapped around said stake. The applicant would then proceed at a 90 degree angle forming the third side of a rectangle laying out additional cord until another corner demarcation is reached. A fourth stake would be inserted into the ground at this corner demarcation and the cord would be pulled taunt to eliminate any slack and drawn against the outside of said stake or wrapped around said stake. The applicant would then proceed at a 90 degree angle back to the point of origination completing the formation of a rectangle and attaching the remaining end of the flexible cord to the first stake that had been placed into the ground. Additional stakes could then be placed periodically at strategic places such as mid field or at various intervals around the perimeter of the now established playing field to further secure the cord restingly on the ground, alleviating any tripping hazard for the participants.

DETAILED DESCRIPTION

Figure 1:
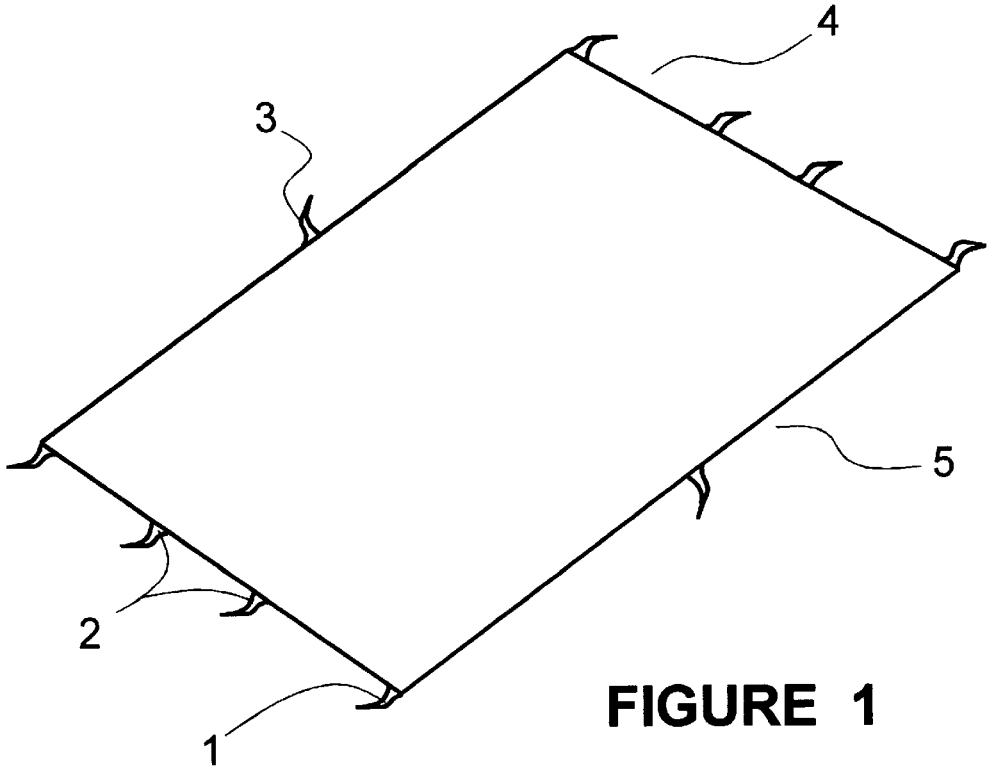
FIG. 1 is a perspective view of the portable field boundary after it has been anchored into place for use.

Refer now to FIG. 1, which is an overall drawing of the preferred embodiment of this invention. This embodiment represents a soccer field and consists of a flexible base cord 720 feet in length with pennants attached thereupon in the appropriate places to denote corners (1), goals (2) and midfield (3). The drawing shown represents a field for which the baselines (4) are 50 yards from corner to corner and the sidelines (5) are 70 yards from corner to corner with the goals (2) being 21 feet wide and equidistant from the corners and midfield demarcations (3) equidistant from corner to corner on the sidelines at a distance of 35 yards from each corner as recommended by the United States Youth Soccer Association for children 9 and 10 years of age.

Figure 2:
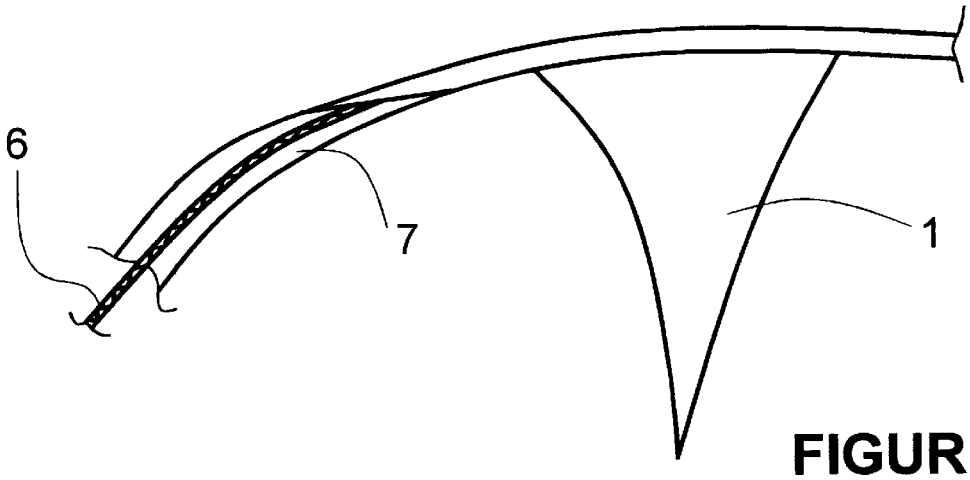
FIG. 2 is an exploded view of the preferred attachment of a pennant to the base cord.

To achieve the desired objectives of portability and economical construction, the preferred embodiment as shown in FIG. 2 consists of pennants (1) made from readily available plastic, nylon, cloth or other material sewn onto a lightweight, durable, multi-stranded nylon cord (6) which is covered by a non adhesive plastic tape (7) typically one i inch wide which is folded over the nylon cord and sewn into permanent placement with stitching on either side of the cord. This manufacturing technique and materials are widely used industry standard materials and techniques used for making signs, banners and pennant streamers.

Figure 3:
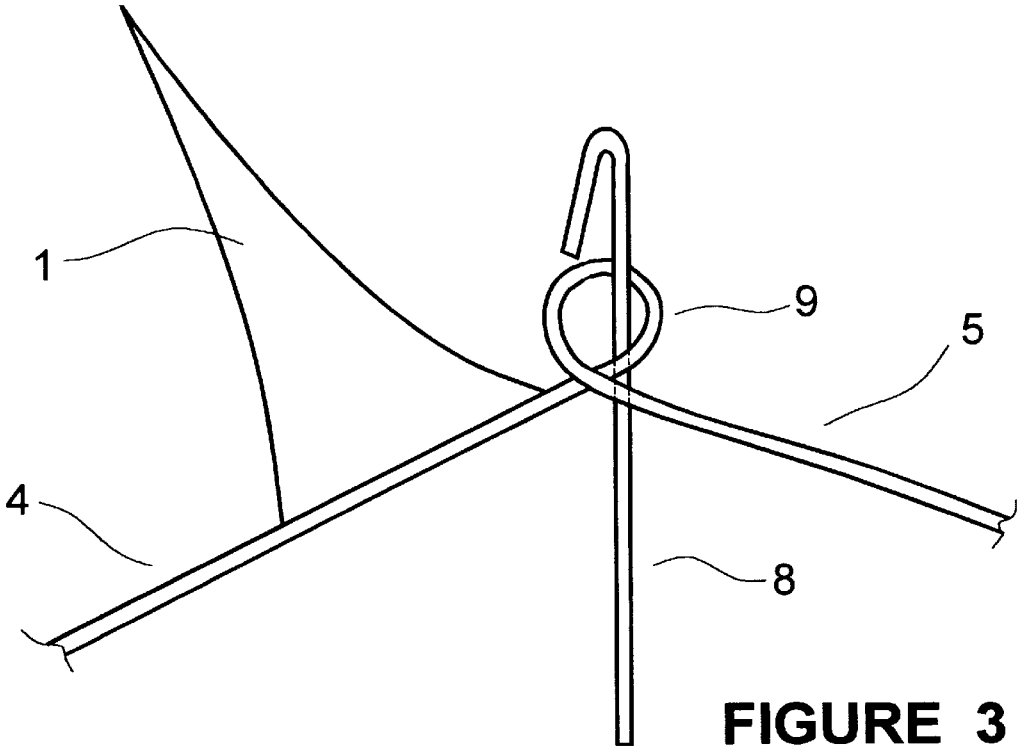
FIG. 3 is a view of a process for anchoring a corner into the ground.
Figure 4:
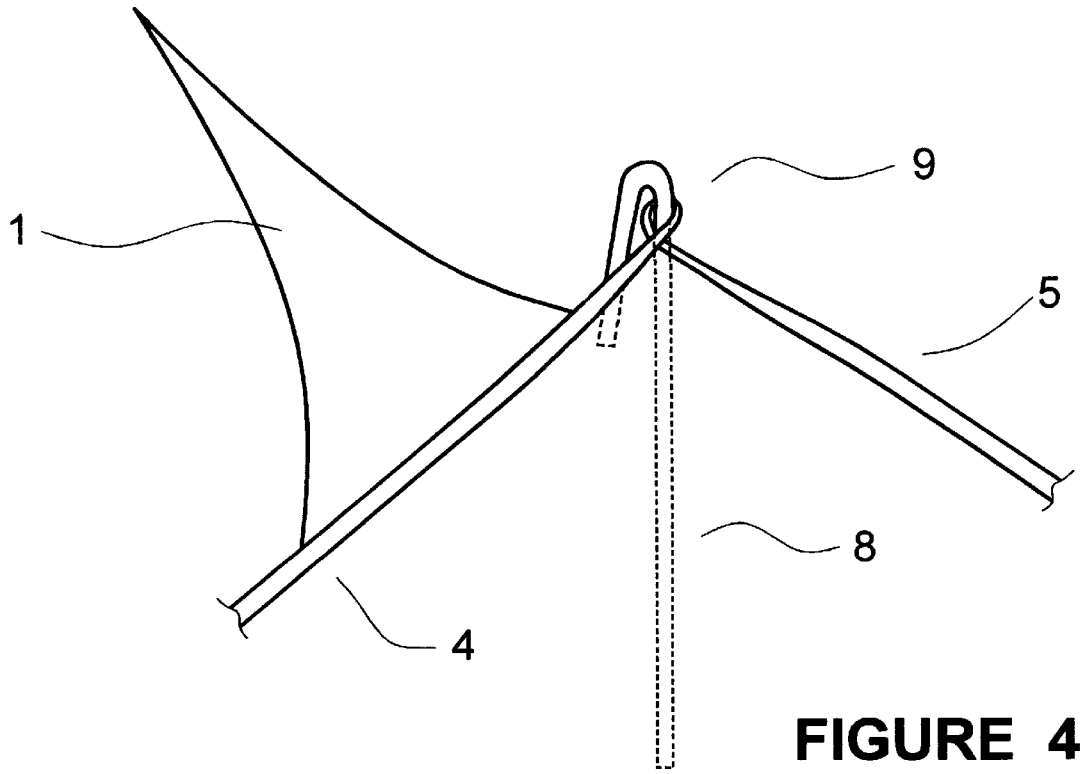
FIG. 4 is a view of a corner after it has been anchored into the ground.

Refer now to FIG. 3. To use the desired invention, the applicant would select an area of sufficient size and, using simple metal stakes (8), would begin application of the field by anchoring one end of the cord to the ground with a stake. The applicant would then proceed to lay out additional cord until an appropriate corner is reached, denoted by a pennant or other marker. The applicant would pull taunt the cord to take up any slack, allowing the cord to lay restingly on the ground in a straight line and, after inserting another stake with approximately half of its shaft length into the ground and the other half remaining above the ground, would wrap the cord around the shaft of the stake (9) and then proceed to insert the remaining exposed shaft of the stake into the ground as shown in FIG. 4 (9). The cord remains lying restingly along the ground with the stake inserted fully into the ground so that any obstruction or hazard to a participant is minimized. The remaining cord length is laid out in the same manner with the corners being 90 degrees and a rectangle being formed upon completion.

This described embodiment including manufacturing methodology, materials and processes are but one of many combinations possible for the desired invention. Different field sizes are often used for soccer and various sizes and field demarcations are readily apparent for other field sports including football, flag football, rugby, field hockey, ultimate frisbee and lacrosse with said demarcations being appropriate for the given sport denoting perimeters, corners, goal lines, yardage markers et al. Other materials could include flexible tape, rope, string, twine, braided cloth or other material and demarcations could include flags, tape, streamers, dye, ink or other markers sewn, glued, printed or otherwise attached.

Therefore, I claim:

1. A portable athletic field demarcation apparatus for quickly and easily marking the boundary or perimeter of a rectangular playing field for practice or competition of field sports such as soccer, football, flag football, rugby, field hockey, ultimate frisbee, lacrosse or others, the apparatus comprising:

a. a continuous flexible outer boundary demarcation element of a length equal to the length of the perimeter of the field to be marked, said length being the sum of the length of the four sides;

b. said outer boundary demarcation element having a first end and a second end separated by a distance equal to the sum of the length of the outer perimeter of desired playing area;

c. said first end of said element and said second end of said element being attached to a common point forming an endless loop;

d. additional demarcation elements attached to, said outer boundary with particular and purposeful placement at predetermined points and distances from one another to denote appropriate defining elements such as corners, goals, goal lines, mid-field, yardage markers or other appropriate and desired points for the sport being practiced or played.

e. said additional demarcation elements using various colors to denote different demarcation points such as corners, goals, goal lines, midfield, yardage markers and other appropriate and desired demarcation points.

2. A portable athletic field demarcation apparatus as in claim 1 further comprising:

a. means for attaching or anchoring said demarcation element to the playing surface;

b. said means for attaching or anchoring said demarcation element to the playing surface allowing said demarcation element to lay restingly on the playing surface forming a rectangular playing area for temporary purposes such as a single practice or competition of a field sport, said demarcation apparatus being retrieved and stored for subsequent uses.

3. A method for fabricating a portable athletic field demarcation apparatus for marking a boundary of a rectangular playing field, said playing field being a predetermined length and width and having two opposing sides and two opposing ends, a perimeter and demarcations denoting desired points such as corners, goals, goal lines, mid-field, yardage markers or other appropriate and desired points for field sports such as soccer, football, flag football, rugby, field hockey, ultimate frisbee, lacrosse or others, the method comprising:

a. providing an elongate flexible element having a first and second end that are separated by a predetermined distance equal to the length of the perimeter of the desired playing field; affixing said first and second ends to a common point to form an endless loop; attaching demarcation elements at predetermined points along said flexible element to denote desired points such as corners, goals, mid-field, yardage markers or other desired points for field sports;

b. said flexible element being made of lightweight and durable material to allow for easy portability, application, and storing of said element for subsequent uses;

c. said flexible element being made by common and established preexisting processes and materials to facilitate the desired objective of an economical portable field demarcation apparatus.

4. The apparatus of claim 1, wherein said additional demarcation elements are permanently positioned on said outer boundary.

5. The apparatus of claim 1, wherein said additional demarcation elements are removably positioned on said outer boundary.

6. The apparatus of claim 1, wherein said additional demarcation elements are printed on said outer boundary.

* * * * *